US008944362B2

(12) United States Patent
Jiang et al.

(10) Patent No.: US 8,944,362 B2
(45) Date of Patent: Feb. 3, 2015

(54) PRINTER, PAPER, ROLL HOLDER THEROF, AND PAPER END DETECTING MECHANISM

(75) Inventors: Tianxin Jiang, Weihai (CN); Zhenxian Cong, Weihai (CN); Jigang Zhang, Weihai (CN); Min Yang, Weihai (CN); Kai Liu, Weihai (CN)

(73) Assignee: Shandong New Beiyang Information Technology Co., Ltd., Weihai (CN)

( * ) Notice: Subject to any disclaimer, the term of this patent is extended or adjusted under 35 U.S.C. 154(b) by 340 days.

(21) Appl. No.: 13/516,404

(22) PCT Filed: Nov. 4, 2010

(86) PCT No.: PCT/CN2010/078431

§ 371 (c)(1),
(2), (4) Date: Jun. 15, 2012

(87) PCT Pub. No.: WO2011/072559

PCT Pub. Date: Jun. 23, 2011

(65) Prior Publication Data

US 2012/0257222 A1 Oct. 11, 2012

(30) Foreign Application Priority Data

Dec. 17, 2009 (CN) ..... 2009 1 0260382

(51) Int. Cl.
*B65H 18/04* (2006.01)
*B41J 11/00* (2006.01)
(Continued)

(52) U.S. Cl.
CPC ..... *B41J 11/0095* (2013.01); *B41J 11/0075* (2013.01); *B41J 15/042* (2013.01); *B41J 29/02* (2013.01); *B41J 29/13* (2013.01); *B41J 29/48* (2013.01)
USPC ..... 242/595; 242/563

(58) Field of Classification Search
USPC ..... 242/563, 563.1, 563.2, 591, 595
See application file for complete search history.

(56) References Cited

U.S. PATENT DOCUMENTS 5,713,678 A * 2/1998 Smith et al. ..... 400/613
5,820,068 A * 10/1998 Hosomi et al. ..... 242/563
(Continued)

FOREIGN PATENT DOCUMENTS

CN 1169372 A 1/1998
CN 2609759 Y 4/2004
(Continued)

OTHER PUBLICATIONS

International Search Report dated Feb. 10, 2011 for corresponding PCT Application No. PCT/CN2010/078431 (11 pgs.).
(Continued)

*Primary Examiner* — William A Rivera
(74) *Attorney, Agent, or Firm* — Shumaker & Sieffert, P.A.

(57) ABSTRACT

A paper roll holder, a printer having the same and a paper end detecting mechanism are disclosed. The paper roll holder comprises a turning plate, which upper surface forms a first arc groove close to a rotation center and a second arc groove far away from the rotation center; an elastic element, providing a rotating torque to the turning plate so that the turning plate turns from an initial position to an upturning position during the printing and consuming of a paper roll; and a sensor, arranged in the second arc groove of the turning plate for detecting the paper. Wherein, the turning plate has the initial position suitable for supporting a large paper roll in the second arc groove and the upturning position suitable for supporting a small paper roll in the first arc groove. When the printing paper roll is near end, along with rotation of the turning plate, the small paper roll is limited in the first arc groove so as to prevent the small paper roll from moving in the paper house during printing. When the residual amount of the printing paper is less than the distance between the sensor and the printing mechanism, the sensor can promptly and accurately send out a paper lack signal, thereby improving the reliability of paper detection by the sensor.

20 Claims, 7 Drawing Sheets

(51) Int. Cl.

| | |
|---|---|
| ***B41J 15/04*** | (2006.01) |
| ***B41J 29/02*** | (2006.01) |
| ***B41J 29/13*** | (2006.01) |
| ***B41J 29/48*** | (2006.01) |

(56) References Cited

U.S. PATENT DOCUMENTS

| | | | | |
|---|---|---|---|---|
| 6,629,666 | B2 * | 10/2003 | Lee et al. | 242/563 |
| 8,240,928 | B2 * | 8/2012 | Tsugaru et al. | 400/583 |
| 2002/0023983 | A1 | 2/2002 | Lee et al. | |

FOREIGN PATENT DOCUMENTS

| | | | |
|---|---|---|---|
| CN | 101722746 | A | 6/2010 |
| CN | 201566217 | U | 9/2010 |
| EP | 0794064 | A2 | 9/1997 |
| EP | 1093928 | A2 | 4/2001 |
| JP | 10279151 | A | 10/1998 |

OTHER PUBLICATIONS

Written Opinion of the International Searching Authority dated Feb. 10, 2011 for corresponding PCT Application No. PCT/CN2010/078431 (10 pgs.).

* cited by examiner

PRINTER, PAPER, ROLL HOLDER THEROF, AND PAPER END DETECTING MECHANISM

The present application claims the priority of Chinese invention patent application No. 200910260382.0, entitled "Printer, Paper Roll Holder Thereof, and Paper End Detecting Mechanism", filed to the Patent Office of the People's Republic of China on Dec. 17, 2009.

TECHNICAL FIELD OF THE INVENTION

The invention relates to a printer, and in particular to a paper roll end detecting mechanism and a paper roll holder.

BACKGROUND OF THE INVENTION

The printer using rolled paper is widely applied to the fields of the supermarkets, department stores, lottery tickets and so on, for printing customer transaction documents.

Due to heavy workload, the printing paper needs to be replaced frequently. Usually, it is necessary to prompt the user to replace the printing paper when the printing paper is near end, in order to avoid paper lack during printing.

The common way is to arrange a paper near end detection mechanism on the side wall of the paper house of the printer to detect the residual amount of the printing paper. When the paper near end detection mechanism detected that the residual amount of the printing paper is less than the predetermined value, the printer sends out alarm information for prompting the user to replace the printing paper.

The paper near end detection mechanism usually can only meet the detection of a certain residual amount of the printing paper, cannot accurately detect the state of paper exhaustion. At this moment, when receiving the information that the paper is near end, the user needs to pay attention to the consumption of the paper roll at any time. Otherwise the problem that the printing content of the ticket paper is incomplete cannot be avoided and causes unnecessary trouble for the user.

In order to improve the user's operation convenience, enable the printer accurately detect the state of the consumption of printing paper, and accurately and timely prompt the user to replace the paper, Japanese patent JP28169 provides a paper end detection method.

As shown in FIG. 1, in this solution, a paper house 1' and a reflective sensor 5' are arranged. The reflective sensor 5' is slightly above the surface of the paper house. When the printing paper is near end, the paper roll becomes lighter, and the paper roll disengages from the paper house by the printing paper. At this moment, the reflective sensor 5' detected the paper lack state, and sends out alarm information of paper exhaustion.

The disadvantage of the solution is that, as the residual amount of the paper gradually decreases, the weight of the paper roll 3' also gradually decreases. It is easy for the paper to drag the small paper roll to roll in the paper house in the process of paper movement. When the small paper roll rolls in the paper house to be outside the detection range of the reflective sensor 5', even if the small paper roll still has residual paper, the reflective sensor 5' may send out a paper lack alarm, which causes an unreliable detection result.

SUMMARY OF THE INVENTION

One of the objects of the invention is to provide a paper roll holder for improving the reliability of the paper detection by a sensor. Another object of the invention is to provide a printer having the paper roll holder. The further object of the invention is to provide a paper end detecting mechanism which is used for the equipment using paper roll such as a printer, so as to improve the reliability of the paper detection by a sensor.

For achieving the foregoing object, in one aspect of the present invention, there is provided a paper roll holder, which is used for forming a cavity holding a paper roll, comprising: a turning plate, which upper surface forms a first arc groove close to a rotation centre and a second arc groove far away from the rotation centre; a sensor, arranged in the second arc groove of the turning plate for detecting the paper; and an elastic element, providing a rotating torque to the turning plate so that the turning plate turns from an initial position to an upturning position during the printing and consuming of a paper roll; wherein, the turning plate has the initial position suitable for supporting a large paper roll in the second arc groove and the upturning position suitable for supporting a small paper roll in the first arc groove.

Preferably, the paper roll holder further comprises a left side plate and a right side plate, which are arranged on the left and right sides of the turning plate for limiting the position of left and right sides of the paper roll.

Preferably, a locating slot is provided on the left side plate and/or the right side plate; the side of the turning plate is provided with a locating pole matched with the locating slot, wherein the locating pole slides in the locating slot when the turning plate rotates.

Preferably, a retractable paper roll locating pole is arranged on the left side plate and/or the right side plate, wherein the paper roll locating pole is used for limiting the position of a core of the paper roll in the first arc groove when the turning plate is located in the upturning position.

Preferably, the sensor is arranged in one side of the second arc groove of the turning plate close to the first arc groove.

Preferably, the first arc groove is a circular arc groove with first curvature radius, the second arc groove is a circular arc groove with second curvature radius, and the second curvature radius is larger than the first curvature radius.

On the other hand, the invention also provides a printer, comprising a main frame, a cover frame hinged to the main frame, a paper roll holder arranged in the main frame, and a printing mechanism, the paper roll holder is the aforesaid paper roll holder.

Preferably, the printer further comprises a returning mechanism which is used for returning the turning plate of the paper roll holder to the initial position when the cover frame is opened.

Preferably, the returning mechanism is a link mechanism, which comprises a gear set, a first link and a second link, wherein the gear set comprises a first gear, a second gear, and at least one transition gear for transmission between the first gear and the second gear in a engaging manner, wherein the first gear is concentrically arranged with a rotating shaft of the cover frame to drive the first gear to rotate while the cover frame is opening; one end of the first link is fixedly connected to the second gear and swings with the second gear, and the other end thereof is provided with a top pillar; one end of the second link is fixedly connected to the turning plate, and the other end thereof is provided with a locking hook matched with the top pillar, wherein when the first link swings, the top pillar of the first link pushes the second link to drive the turning plate to rotate from the upturning position to the initial position.

Additionally, the invention also provides a paper end detecting mechanism, the paper end detecting mechanism comprises: a turning plate, which the upper surface forms a first arc groove close to a rotation centre and a second arc groove far away from the rotation centre; an elastic element, providing a rotating torque to the turning plate so that the turning plate turns from an initial position to an upturning position during the printing and consuming of a paper roll; and a sensor, arranged in the second arc groove of the turning plate for detecting the paper, wherein the turning plate has the initial position suitable for supporting a small paper roll in the second arc groove and the upturning position suitable for supporting a large paper roll in the first arc groove.

Preferably, a locating pole is formed on one side or both sides of the turning plate, and rotatably arranged in the locating slot along with the turning plate, wherein the top stop end of the locating slot corresponds to the upturning position of the turning plate, and the bottom stop end thereof corresponds to the initial position of the turning plate.

Preferably, the sensor is arranged in one side of the second arc groove of the turning plate close to the first arc groove.

In the paper end detecting mechanism or paper roll holder according to the invention, the turning plate comprises the first arc groove for accommodating the small paper roll and the second arc groove for accommodating the large paper roll. When the printing paper roll is near end, along with rotation of the turning plate, the small paper roll is limited in the first arc groove so as to prevent the small paper roll from moving in the paper house during printing. In such a way, once the residual amount of the printing paper is less than the distance between the sensor and the printing mechanism, the sensor can promptly and accurately send out a paper lack signal to prompt the user to replace medium, thereby improving the reliability of paper detection by the sensor. Additionally, the invention also provides the link mechanism so that it is unnecessary to add additional operation steps during loading paper after the paper end detecting mechanism is added, so as to ensure the easy operation of the printer.

In addition to the above described objects, features and advantages, the invention also has other objects, features and advantages. The invention will be further described in detail below with reference to the drawings.

BRIEF DESCRIPTION OF THE DRAWINGS

The accompanying drawings, which constitute a part of this specification and are intended to further understand the invention, illustrate the preferred embodiments of the invention and, together with the specification, explain the principles of the invention. In the drawings.

DETAILED DESCRIPTION OF THE INVENTION

The embodiments of the invention will be described in detail below in conjunction with the drawings, but the invention may be implemented by many different ways defined and covered by the claims.

In the invention, the term "large paper roll" is a paper roll, the diameter of which is less than the second circular arc groove and larger than the first circular arc groove, which is unused or abundant in the residual amount of the paper. The term "small paper roll" is a to-be-exhausted paper roll, the diameter of which is less than the first circular arc groove.

FIG. 2 to FIG. 5 illustrate structure views of a printer according to the preferred embodiment of the invention. With reference to FIG. 2 to FIG. 5*a*, in the preferred embodiment, the printer comprises a printing component 1, a paper roll holder 2, and a link mechanism.

Figure 1:
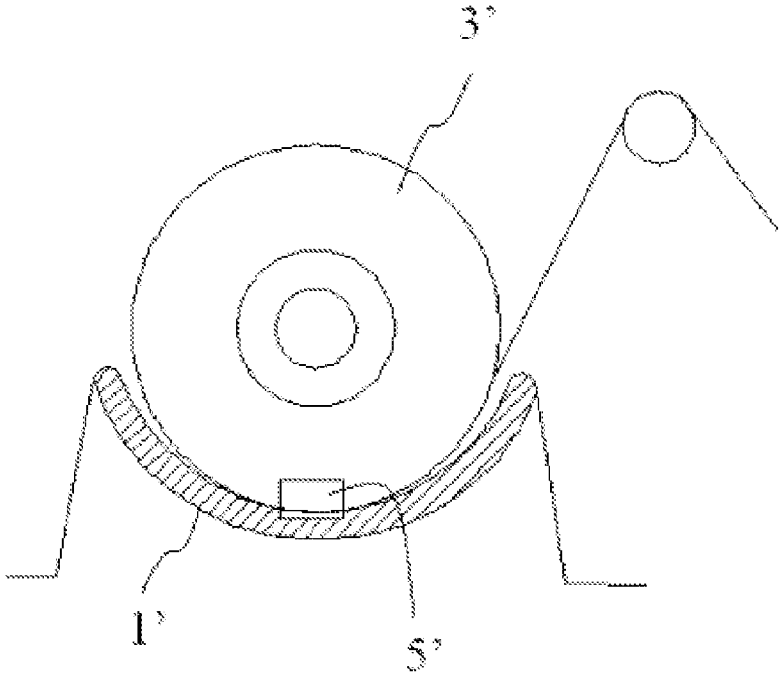
Fig. 1 Prior Art
FIG. 1 illustrates a schematic view of a conventional paper end detecting device.
Figure 2:
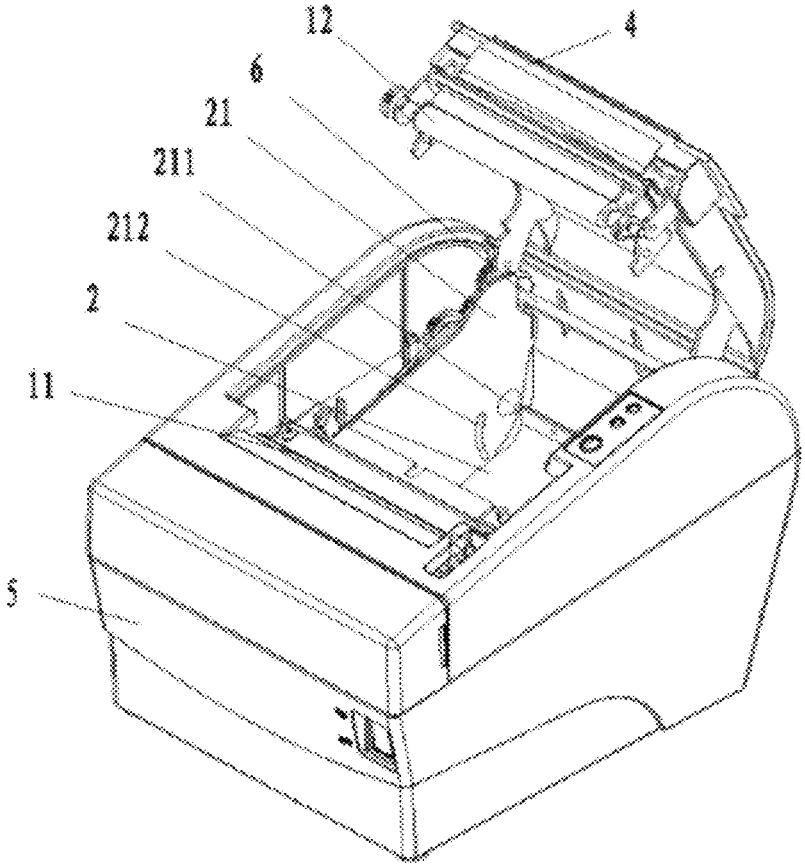
FIG. 2 illustrates an isometric view of a printer according to the preferred embodiment of the invention.

As shown in FIG. 2, the printing component 1 comprises a printing head 11 and a printing roller 12, wherein the printing head 11 is arranged on the main frame 5 of the printer, the printing roller 12 is arranged on the cover frame 4 of the printer, the cover frame 4 is hinged with the main frame 5 through a rotating shaft 6, and the cover frame 4 can be opened and closed relative to the main frame 5.

Figure 5A:
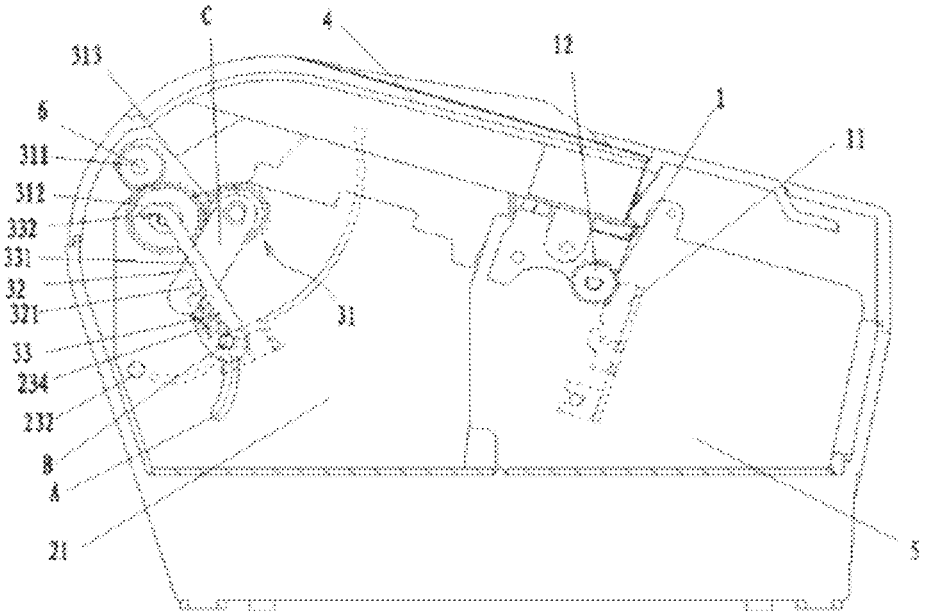
FIG. 5*a* illustrates a structure view of a link mechanism when an cover frame of a printer is closed according to the invention.

As shown in FIG. 5*a*, when the cover frame 4 is closed relative to the main frame 5, the printing head 11 and the printing roller 12 are tangent, the printing roller 12 rotates by a driving system (not shown in the figure) to drive the printing paper forward, and at the same time the printing head 11 prints on the paper.

Figure 3:
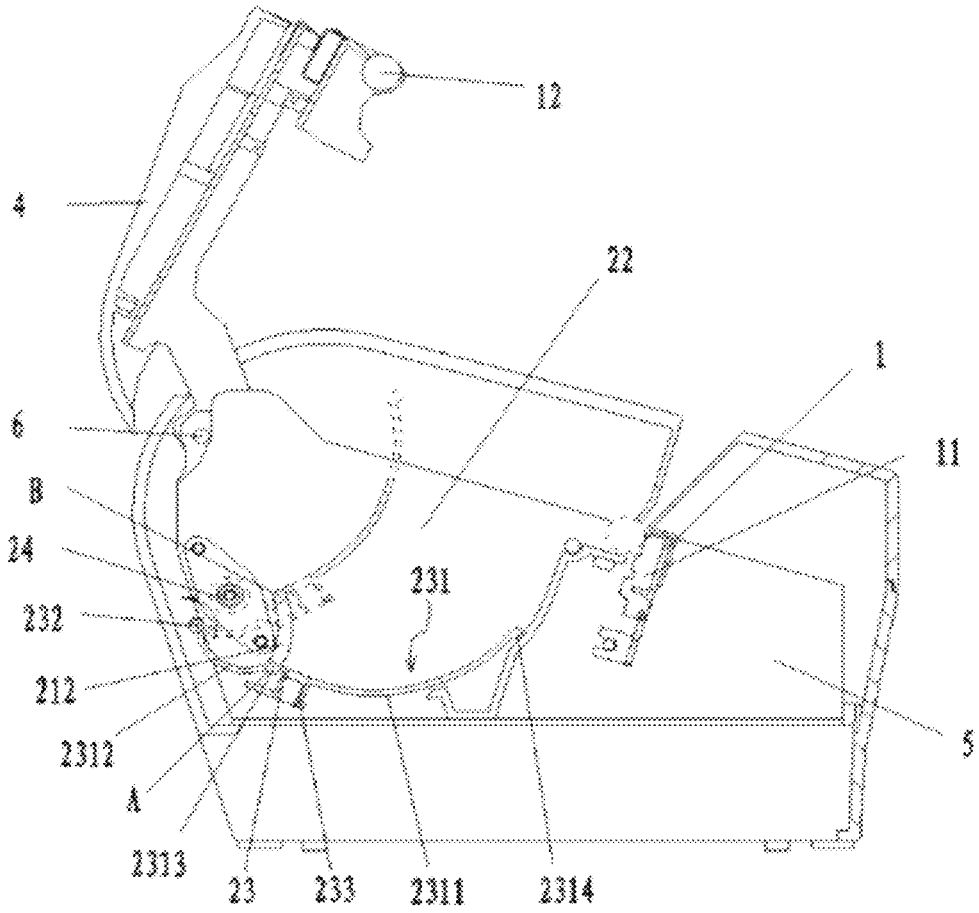
FIG. 3 illustrates a structure view of a paper end detecting mechanism of a printer according to the preferred embodiment of the invention.

As shown again in FIG. 2, the paper roll holder 2 comprises a left side plate 21, a right side plate 22 and a paper end detecting mechanism 23 (shown in FIG. 3).

Among them, the left side plate 21 is opposite to the right side plate 22, with a spacing being matched with the width of the printing paper roll to limit the movement range of the paper roll in the width direction of the paper.

As shown in FIG. 3, the paper end detecting mechanism 23 comprises a turning plate 231, a turning shaft 232, a paper sensor 233 and an elastic element 234 (shown in FIG. 5*a*).

Among them, the turning plate 231 can rotate around its own rotation centre within a predetermined rotation angle. The turning plate 231 comprises a first circular arc groove 2312, a second circular arc groove 2311 and a limiting pole 2313. Preferably, the turning plate 231 is hinged with the left side plate 21 and the right side plate 22 of the paper roll holder through the turning shaft 232 and rotates around the centre which is the turning shaft 232.

The second circular arc groove 2311 is fixedly connected with the first circular arc groove 2312, the circular arc radius of the second circular arc groove 2311 is larger than or equal to the maximum radius of the paper roll supported by the printer, and the circular arc radius of the first circular arc groove 2312 is slightly larger than the radius of the paper roll core.

The limiting pole 2313 is arranged on the side of the turning plate 231, may be arranged on one side of the turning plate 231 or on the left side and the right side of the turning plate 231 symmetrically.

In the preferred embodiment, the limiting pole 2313 is arranged on one side of the turning plate 231 near the left side plate 21, the limiting pole 2313 protrudes towards the left side plate 21, correspondingly, a slot hole 212, the size of which is matched with the limiting pole 2313, is arranged on the left side plate 21.

Under the joint limit of the limiting pole 2313 and the slot hole 212, the turning plate 231 can only rotate around the turning shaft 232 within the range between the set lowest position A (namely, the initial position) and the highest position B (namely, the upturning position).

The paper sensor 233 is fixed on one end of the second circular arc groove 2311 close to the first circular arc groove 2312, and used for detecting whether the paper exists or not.

The end portion of the second circular arc groove 2311 is close to the printing component 1, and the end portion of the first circular arc groove 2312 is hinged with the main frame 5 through the turning shaft 232.

The elastic element 234 may be a pullback spring, also may be a torsion spring.

In the preferred embodiment, the pullback spring is used, one end of the elastic element 234 is connected with the main frame 5 of the printer, while the other end is connected with the turning plate 231, so there is always a tendency that the turning plate 231 turns towards the cover frame 4 of the printer.

It should be noted that, the slot hole 212 arranged on the left side plate 21 of the paper roll holder 2 is located on the circular arc, which takes the turning shaft 232 as a centre, and the distance from the limiting pole 2313 to the turning shaft 232 as a rotating radius.

In order to improve the moving stability of the small paper roll fallen into the first circular arc groove during printing, the paper roll holder also comprises a small paper roll locating mechanism 24 (shown in FIG. 3).

Figure 4:
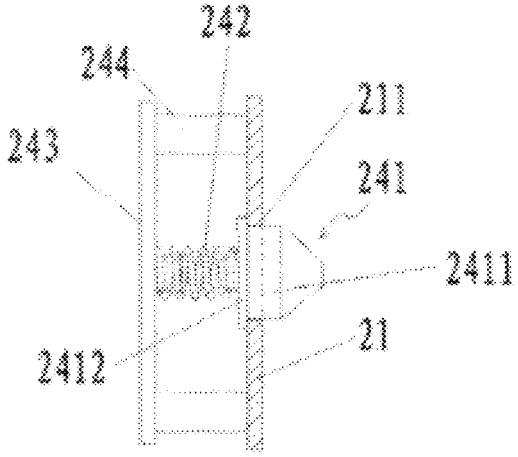
FIG. 4 illustrates a structure view of a small paper roll locating mechanism in a printer according to the invention.

As shown in FIG. 4, the small paper roll locating mechanism 24 comprises a paper roll locating pole 241, a compression spring 242, a top plate 243 and a fixing pole 244.

Among them, the paper roll locating pole 241 comprises a first cylinder 2411 and a second cylinder 2412, the tail end of the first cylinder 2411 is provided with a chamfer, and the outside diameter of the second cylinder 2412 is larger than that of the first cylinder 2411.

The small paper roll locating mechanism 24 may be arranged on either the left side plate 21 or the right side plate 22, and also may be arranged on the two side plates symmetrically.

In the preferred embodiment, the top plate 243 is fixed on the left side plate through the fixing pole 244, the top plate 243 props against the compression spring 242, the compression spring 242 compresses the paper roll locating pole 241. A locating hole 211 is arranged at a corresponding position of the left side plate 21 of the paper roll holder 2. The diameter of the locating hole 211 is slightly larger than the outside diameter of the first cylinder 2411, and smaller than the outside diameter of the second cylinder 2412. Under the compression of the compression spring 242, the first cylinder 2411 goes through the locating hole 211, projects from the left side plate 21 of the paper roll holder 2, and extends into the paper roll holder 2.

Preferably, the locating hole 211 is located at the centre position of the first circular arc groove 2312 when the turning plate 231 turns to the highest position B of the slot hole 212 on the left side plate 21 of the paper roll holder 2.

In order to improve the simplicity of replacing the printing paper, the printer of the invention also comprises a link mechanism, which is shown in FIG. 5*a*.

As shown in FIG. 5*a*, the link mechanism may be fixedly installed on either the left side plate 21 or the right side plate 22 of the paper roll holder 2, also may be arranged on the left and right side plates of the paper roll holder 2 symmetrically.

In the embodiment, the link mechanism is arranged on the left side plate 21 of the paper roll holder 2, specifically comprising a gear set 31, a first link 32 and a second link 33.

Among them, the gear set 31 comprises a first gear 311, a transition gear 312 and a second gear 313.

The first gear 311 is fixedly connected with the cover frame 4 into one piece, and rotates along with the opening and closing of the cover frame 4. Preferably, the centre of the first gear 311 is concentric with the rotating shaft 6.

The transition gear 312 is engaged with the first gear 311, and at the same time engaged with the second gear 313.

The first link 32 is fixedly connected with the second gear 313, and can swing synchronously along with the rotation of the second gear 313.

The second link 33 is fixedly connected with the limiting pole 2313 of the paper end detecting mechanism 23, specifically comprising a link arm 331 and a link hook 332 arranged on one end far away from the limiting pole 2313.

As the second link 33 is fixedly connected with the turning plate 231 as one piece through the limiting pole 2313, the second link 33 rotates synchronously along with the turning plate 231.

In such a way, in the case of no paper roll in the paper roll holder when the cover frame 4 is closed, the first link 32 is located at the initial position C, and the second link 33 and the turning plate 231 are located at the highest position B; when the cover frame 4 is opened, the first gear 311 rotates along with the cover frame 4 to drive the first link 32 to swing from the initial position C to a paper loading position D, and the top pillar 321 on the first link 32 pushes the link arm 331 of the second link 33 to move.

As the first link 32 swings, the second link 33 and the turning plate 231 move from the highest position B to the lowest position A along the slot hole 212, when the second link 33 reaches the lowest position A, the top pillar 321 reaches the circular arc of the link hook 332.

In the case of the paper roll in the paper roll holder, when the cover frame 4 is closed, the first link 32 is located at the initial position C, the second link 33 and the turning plate 231 are located between the highest position B and the lowest position A according to the size of the paper roll.

When the cover frame 4 is opened, the first link 32 starts swinging from the initial position C. When the top pillar 321 contacts with the link arm 331 of the second link 33, the first link 32 pushes the second link 33 and the turning plate 231 to move until they move to the lowest position A.

The working principle of the invention is described below according to an operation order of the printer. As shown in FIG. 5*a*, when the cover frame 4 of the printer is closed and no paper roll is placed in the paper roll holder 2, the turning plate 231 is under the action of the elastic element 234, the limiting pole 2313 is located at the highest position B of the slot hole 212, and at this time the turning plate 231 is located at the highest position.

Figure 5B:
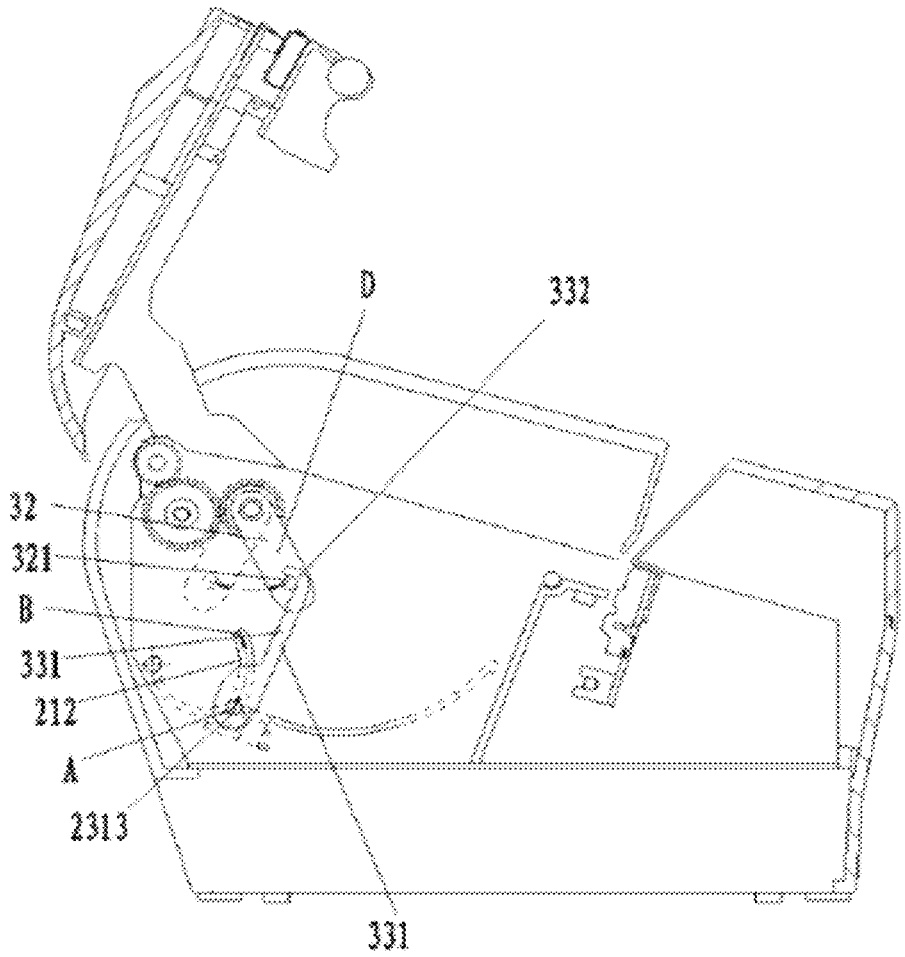
FIG. 5*b* illustrates a structure view of a link mechanism when an cover frame of a printer is opened according to the invention.

As shown in FIG. 5*b*, along with the opening of the cover frame 4 of the printer, the first gear 311 of the link mechanism also rotates, the transition gear 312 engaged with the first gear 311 drives the second gear 313 engaged with the transition gear 312 to rotate in a direction the same as the direction in which the cover frame 4 is opened, the first link 32 fixedly installed on the second gear 313 swings from the initial position C to the paper loading position D along with the second gear 313. Along with the swinging of the first link 32, the top pillar 321 on the first link 32 moves along the link arm 331 of the second link 33.

The second link 33, driven by the top pillar 321, moves from the highest position B to the lowest position A along the slot hole 212. When the cover frame 4 of the printer is opened to the maximum angle, the top pillar 321 is matched with the link hook 332, and the turning plate 231 turns to the lowest position A for loading the paper roll directly.

Figure 6A:
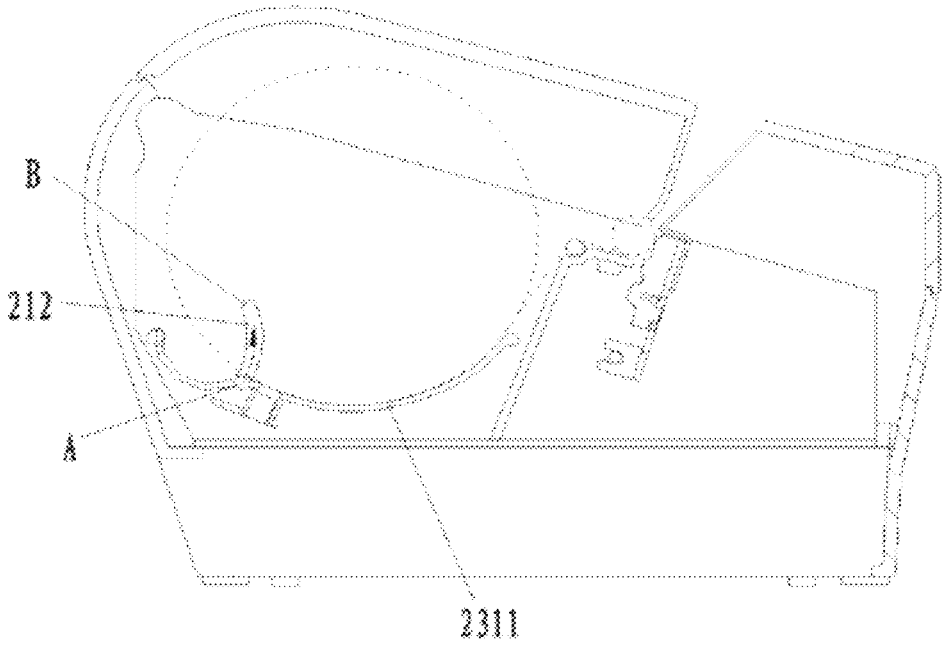
FIG. 6*a* illustrates a schematic view of a paper end detecting mechanism when the outside diameter of a paper roll used is larger after a top cover of a printer is closed according to the invention.

FIG. 6*a* is a schematic view of a paper end detecting mechanism when the outside diameter of the paper roll used is larger after the top cover of the printer is closed. As shown in FIG. 6*a*, at this time the weight of the paper roll is larger than the force of the elastic element, the paper roll is located in the second circular arc groove 2311 of the turning plate 231, the turning plate 231 is located at the lowest position A, and the paper sensor 233 detected that there is paper in the printer.

Figure 6B:
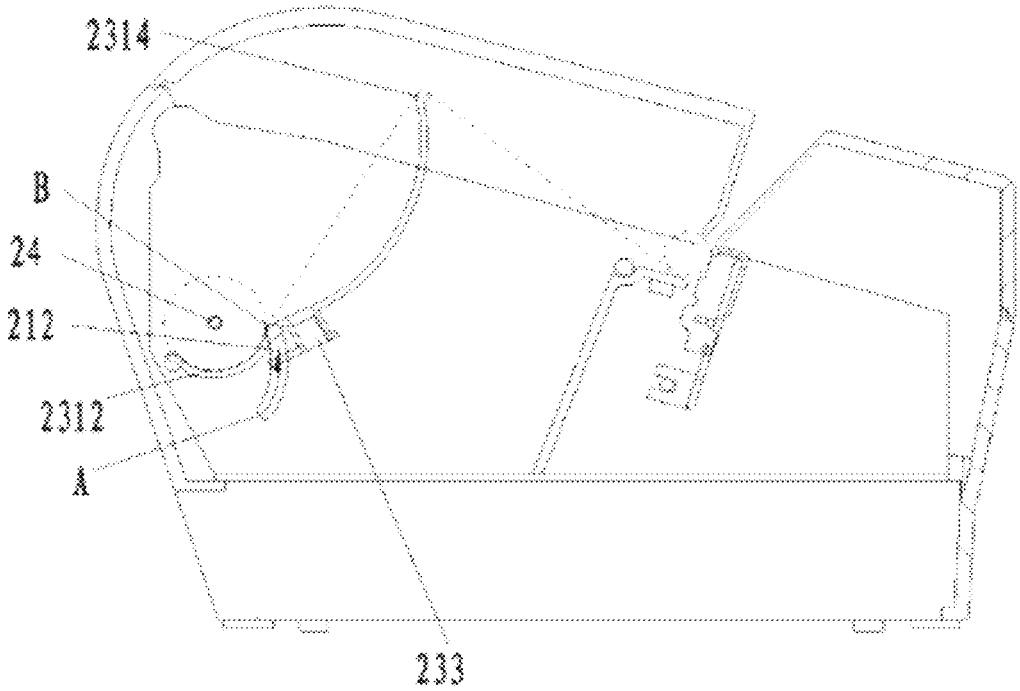
FIG. 6*b* illustrates a schematic view of a paper end detecting mechanism when a paper roll is exhausted after a top cover of a printer is closed according to the invention.

FIG. 6*b* is a schematic view of the paper end detecting mechanism when the paper roll is exhausted after the top cover of the printer is closed. As shown in the figure, along with the consumption of the printing paper, the paper roll is decreased gradually in outside diameter, and becomes lighter in weight. When the weight of the paper roll is smaller than the force of the elastic element, the turning plate 231 turns. When the limiting pole 2313, taking the turning shaft 232 as a centre, rotates from the lowest position A to the highest position B along the slot hole 212, the paper roll rolls and falls into the first circular arc groove 2312 from the second circular arc groove 2311 along with the turning of the turning plate 231.

When the paper roll rolls from the second circular arc groove 2311 into the first circular arc groove 2312, the locating pole 241 of the small paper roll locating mechanism 24 installed on the left side plate 21 of the paper roll holder 2 is extruded by the paper roll to move towards the top plate 243. Along with the continuous movement of the paper roll, when the small paper roll locating mechanism 24 is aligned with the paper roll core, the locating pole 241 pops out under the action of the compression spring 242, and inserts into the paper roll core. So the position of the paper roll is fixed, and the problem, which the small paper roll is disengaged from the turning plate 231 because the small paper roll is pulled by the printing paper, is avoided. At this moment, the paper sensor 233 detected that paper exists in the printer.

Figure 6C:
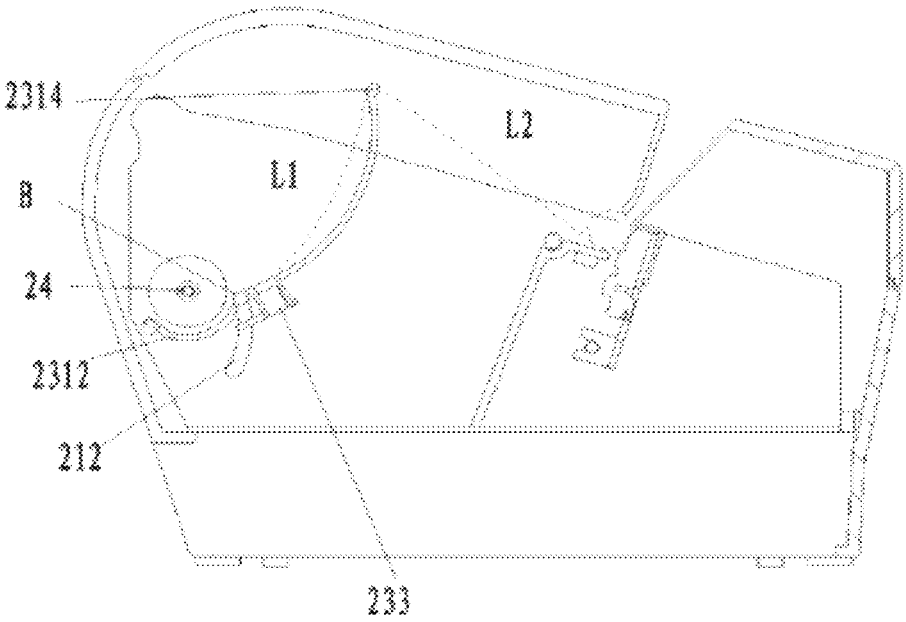
FIG. 6*c* illustrates a schematic view of a paper end detecting mechanism when a printing paper roll is exhausted and the tail end of the paper is disengaged from the paper roll core according to the invention.

FIG. 6*c* is a schematic view of the paper end detecting mechanism 23 when a printing paper roll is exhausted and the tail end of paper is disengaged from a paper roll core. As shown in the figure, the distance from the tail end of the printing paper to the tail end 2314 of the turning plate is set to L1, the distance from the tail end 2314 of the turning plate to the printing head 11 is set to L2, and the length of paper pre-stored in the printer is set to L, L=L1+L2.

When the tail end of printing paper is disengaged from the paper roll core, the paper sensor 233 of the paper end detecting mechanism 23 detected the state of paper lack, and transfers the information of paper lack to the printer. The printer performs a calculation after receiving the information of paper lack. If the sum of the length of the residual printing content of the current printed ticket of the printer and the length of one printed ticket is smaller than the preset value L, the printer continues to print and calculates the paper feeding distance after printing the current ticket, stops printing until the residual length of the paper is smaller than the length of one ticket, and sends out an alarm information to prompt the user to replace the paper roll.

If the sum of the length of the residual printing content of the current printed ticket and the length of one printed ticket is larger than the preset value L, the printer stops printing after finishing the printing task of the current printed ticket, sends out an alarm information to prompt the user to replace the paper roll.

It is easy to understand that, the first circular arc groove and the second circular arc groove for supporting the paper roll also may be replaced by other non-circular arc grooves. In the invention, the circular arc grooves and other shape's grooves suitable for supporting the paper roll are called arc grooves.

Additionally, the link mechanism for returning the turning plate to the initial position when the cover frame is opened also may be replaced by other returning mechanism. For example, when the cover frame is opened, the turning plate is driven by a motor driving mechanism to return to the initial position, or the turning plate is attracted or repulsed to the initial position in a way that an electromagnet obtains electricity.

It can be seen from the above description that, in the printer of the invention, the turning plate comprises the second arc groove for accommodating the large paper roll and the first arc groove for accommodating the small paper roll. When the printing paper roll is to be exhausted, along with rotation of the turning plate, the small paper roll is limited in the first arc groove so as to prevent the small paper roll from moving in the paper house during printing.

In such a way, once the residual amount of the printing paper is less than the distance between the sensor and the printing mechanism, the sensor can promptly and accurately send out a paper lack signal to prompt the user to replace medium, thereby improving the reliability of paper detection by the sensor.

Additionally, the invention also provides the link mechanism so that it is unnecessary to add additional operation steps during loading paper after the paper end detecting mechanism is added, so as to ensure the easy operation of the printer.

The above is only the preferred embodiment of the invention and not intended to limit the scope of protection of the invention. For those skilled in the art, various alterations and changes may be made to the invention. Any modifications, equivalent replacements, improvements and the like made within the spirit and principle of the invention shall fall within the scope of protection of the invention.

What is claimed is:

1. A paper roll holder, comprising:

a turning plate, which upper surface forms a first arc groove close to a rotation centre and a second arc groove far away from the rotation centre;

an elastic element, providing a rotating torque to the turning plate so that the turning plate turns from an initial position to an upturning position during the printing and consuming of a paper roll; and a sensor, arranged in the second arc groove of the turning plate for detecting the paper, wherein, the turning plate has the initial position suitable for supporting a large paper roll in the second arc groove and the upturning position suitable for supporting a small paper roll in the first arc groove.

2. The paper roll holder according to claim 1, wherein the paper roll holder further comprises a left side plate and a right side plate, which are arranged on the left and right sides of the turning plate for limiting the position of left and right sides of the paper roll.

3. The paper roll holder according to claim 2, wherein, a locating slot is provided on the left side plate and/or the right side plate;

the side of the turning plate is provided with a locating pole matched with the locating slot, wherein the locating pole slides in the locating slot when the turning plate rotates.

4. The paper roll holder according to claim 2, wherein a retractable paper roll locating pole is arranged on the left side plate and/or the right side plate, wherein the paper roll locating pole is used for limiting the position of a core of the paper roll in the first arc groove when the turning plate is located in the upturning position.

5. The paper roll holder according to claim 1, wherein the sensor is arranged in one side of the second arc groove of the turning plate close to the first arc groove.

6. The paper roll holder according to claim 1, wherein the first arc groove is a circular arc groove with first curvature radius, the second arc groove is a circular arc groove with second curvature radius, and the second curvature radius is larger than the first curvature radius.

7. A printer, comprising a main frame, a cover frame hinged to the main frame, a paper roll holder arranged in the main frame, and a printing mechanism, wherein the paper roll holder comprises:

a turning plate, which upper surface forms a first arc groove close to a rotation centre and a second arc groove far away from the rotation centre;

an elastic element, providing a rotating torque to the turning plate so that the turning plate turns from an initial position to an upturning position during the printing and consuming of a paper roll; and a sensor, arranged in the second arc groove of the turning plate for detecting the paper, wherein, the turning plate has the initial position suitable for supporting a large paper roll on the second arc groove and the upturning position suitable for supporting a small paper roll on the first arc groove.

8. The printer according to claim 7, wherein the printer further comprises a returning mechanism which is used for returning the turning plate of the paper roll holder to the initial position when the cover frame is opened.

9. The printer according to claim 8, wherein the returning mechanism is a link mechanism, which comprises a gear set, a first link and a second link, wherein the gear set comprises a first gear, a second gear, and at least one transition gear for transmission between the first gear and the second gear in a engaging manner, wherein the first gear is concentrically arranged with a rotating shaft of the cover frame to drive the first gear to rotate when the cover frame is opened;

one end of the first link is fixedly connected to the second gear and swings with the second gear, and the other end thereof is provided with a top pillar;

one end of the second link is fixedly connected to the turning plate, and the other end thereof is provided with a locking hook matched with the top pillar, wherein, when the first link swings, the top pillar of the first link pushes the second link to drive the turning plate to rotate from the upturning position to the initial position.

10. The printer according to claim 7, wherein the paper roll holder further comprises a left side plate and a right side plate, which are arranged on the left and right sides of the turning plate for limiting the position of left and right sides of the paper roll.

11. The printer according to claim 10, wherein, a locating slot is provided on the left side plate and/or the right side plate;

the side of the turning plate is provided with a locating pole matched with the locating slot, wherein the locating pole slides in the locating slot when the turning plate rotates.

12. The printer according to claim 11, wherein the printer further comprises a returning mechanism which is used for returning the turning plate of the paper roll holder to the initial position when the cover frame is opened.

13. The printer according to claim 12, wherein the returning mechanism is a link mechanism, which comprises a gear set, a first link and a second link, wherein the gear set comprises a first gear, a second gear, and at least one transition gear for transmission between the first gear and the second gear in a engaging manner, wherein the first gear is concentrically arranged with a rotating shaft of the cover frame to drive the first gear to rotate when the cover frame is opened;

one end of the first link is fixedly connected to the second gear and swings with the second gear, and the other end thereof is provided with a top pillar;

one end of the second link is fixedly connected to the turning plate, and the other end thereof is provided with a locking hook matched with the top pillar, wherein, when the first link swings, the top pillar of the first link pushes the second link to drive the turning plate to rotate from the upturning position to the initial position.

14. The printer according to claim 10, wherein a retractable paper roll locating pole is arranged on the left side plate and/or the right side plate, wherein the paper roll locating pole is used for limiting the position of a core of the paper roll in the first arc groove when the turning plate is located in the upturning position.

15. The printer according to claim 14, wherein the printer comprises a returning mechanism which is used for returning the turning plate of the paper roll holder to the initial position when the cover frame is opened.

16. The printer according to claim 10, wherein the printer further comprises a returning mechanism which is used for returning the turning plate of the paper roll holder to the initial position when the cover frame is opened.

17. The printer according to claim 16, wherein the returning mechanism is a link mechanism, which comprises a gear set, a first link and a second link, wherein the gear set comprises a first gear, a second gear, and at least one transition gear for transmission between the first gear and the second gear in a engaging manner, wherein the first gear is concentrically arranged with a rotating shaft of the cover frame to drive the first gear to rotate when the cover frame is opened;

one end of the first link is fixedly connected to the second gear and swings with the second gear, and the other end thereof is provided with a top pillar;

one end of the second link is fixedly connected to the turning plate, and the other end thereof is provided with a locking hook matched with the top pillar, wherein, when the first link swings, the top pillar of the first link pushes the second link to drive the turning plate to rotate from the upturning position to the initial position.

18. The printer according to claim 7, wherein the sensor is arranged in one side of the second arc groove of the turning plate close to the first arc groove.

19. The printer according to claim 7, wherein the first arc groove is a circular arc groove with first curvature radius, the second arc groove is a circular arc groove with second curvature radius, and the second curvature radius is larger than the first curvature radius.

20. A paper end detecting mechanism, comprising:

a turning plate, which upper surface forms a first arc groove close to a rotation centre and a second arc groove far away from the rotation centre;

an elastic element, providing a rotating torque to the turning plate so that the turning plate turns from an initial position to an upturning position during the printing and consuming of a paper roll; and a sensor, arranged in the second arc groove of the turning plate for detecting the paper, wherein the turning plate has the initial position suitable for supporting a small paper roll in the second arc groove and the upturning position suitable for supporting a large paper roll in the first arc groove.

* * * * *